US005497931A

United States Patent [19]

Nakamura

[11] Patent Number: 5,497,931

[45] Date of Patent: Mar. 12, 1996

[54] STAPLER FOR DISPENSING STAPLES OF DIFFERENT SIZES

[75] Inventor: Yasuhiko Nakamura, Abiko, Japan

[73] Assignee: Maruzen Kabushiki Kaisha, Tokyo, Japan

[21] Appl. No.: 110,440

[22] Filed: Aug. 23, 1993

[30] Foreign Application Priority Data

Aug. 24, 1992 [JP] Japan ..... 4-223746

[51] Int. Cl.[6] ..... B25C 5/02; B25C 5/16

[52] U.S. Cl. ..... 227/109; 227/119; 227/137

[58] Field of Search ..... 227/109, 119, 227/137, 120

[56] References Cited

U.S. PATENT DOCUMENTS

| | | | |
|---|---|---|---|
| 1,907,849 | 5/1933 | Maynard | 227/109 |
| 1,983,398 | 12/1934 | Polzer | 227/109 |
| 2,332,257 | 10/1943 | Polzer | 227/109 |
| 5,096,109 | 3/1992 | Chen | 227/109 |

FOREIGN PATENT DOCUMENTS

| | | | |
|---|---|---|---|
| 180568 | 7/1990 | Japan | 227/109 |
| 2165793 | 4/1986 | United Kingdom | 227/109 |

*Primary Examiner*—Rinaldi I. Rada

*Attorney, Agent, or Firm*—Christopher R. Pastel; Thomas R. Morrison

[57] ABSTRACT

A stapler has a staple magazine with a plurality of staple clips. Each clip is designed to hold a different staple. The desired staple size is selected by rotating an indicator until a staple magazine contacts an inserted stack of paper. Once known, the desired staple clip can be selected by unlocking the staple magazine for rotation about a suspension rod until the desired clip is above an anvil. The magazine is locked, and a staple is punched therefrom. The act of locking, selecting and unlock is accomplished with only one hand.

6 Claims, 12 Drawing Sheets

STAPLER FOR DISPENSING STAPLES OF DIFFERENT SIZES

BACKGROUND OF THE INVENTION

The present invention relates to a stapler. More particularly, the present invention relates to a stapler for distributing staples of different sizes.

Japanese Laid-Open Patent Publication No. 180568/1990 discloses a stapler for dispensing staples of different sizes by choosing an appropriate staple magazine based on the size of the staples stored therein. To select a staple size, a user rotates a release lever at the rear of the stapler. One hand moves a lock pin against a spring, thereby unlocking a rear suspension plate of a staple container. At the same time, a second hand of the user rotates the staple container around a suspension rod until the desired staple magazine is located beneath a follow blade. The lock pin is then returned to a stopper hole of the rear suspension plate corresponding to the section of the staple container containing the desired staples, thereby locking the desired staple magazine in place.

A drawback of this prior art stapler is that a user must employ both hands to unlock the staple container and to select an appropriate staple magazine.

OBJECTS AND SUMMARY OF THE INVENTION

Accordingly, it is an object of the present invention to overcome the drawbacks of the prior art.

It is a further object of the present invention to provide a stapler which allows for unlocking the staple container and selecting different size staples using only one hand.

To achieve the aforementioned objects, the present invention uses an operating assembly which has a suspension rod extending in the fore and aft direction at its upper end, and a lock pin projecting forward from its lower front end. The staple container is installed in the operating assembly for rotation about the supporting rod.

The staple container consists of parallel front and rear supporting members and a crescent-shaped magazine fixed therebetween. The magazine has a plurality of staple containing sections, each for holding a set of staples of a different size. The front supporting member has a guide plate, from which guide pins project forward, and an arcuate guide groove through which a lock pin is inserted. A lock plate is pushed toward the guide plate. The lock plate is free to move back and forth on the guide pins of the guide plate. Laterally arranged lock holes through the lock plate are located at intervals corresponding to the staple containing sections. Operation buttons at both lateral sides of the lock plate permit unlocking the lock plate.

The staple size is changed by depressing the operation buttons found at the sides of the front supporting member with one hand. The staple container is then rotated laterally about the suspension rod by the same hand while holding both operation buttons depressed. When the desired staple size is located directly beneath the follow blade of the operating assembly, the operation buttons are released and the staple container is thereby locked in position.

According to a preferred embodiment of the invention, there is provided a stapler comprising means for containing at least first and second staple strips, means for permitting rotation of said means for containing to bring a selectable one of said first and second staple strips into an operating location, said means for permitting rotation further containing means for locking said means for containing into said operating location, hand-operated means, operable by a single hand of a user, for unlocking said means for containing to permit rotation thereof, and means for permitting rotation of said means for containing using said single hand of said user that is used for unlocking.

According to a feature of the invention, there is provided a stapler comprising means for driving a staple, said means for driving including means for lowering a staple container a distance required to bring a bottom of said staple container into contact with a top surface of an object, and for thereafter driving a staple into said object, and means for indicating said distance, whereby a required staple length can be determined.

According to a further feature of the invention, there is provided a stapler comprising means for containing at least first and second staple strips, means for permitting rotation of said means for containing to bring a selectable one of said first and second staple strips into an operating location, said means for permitting rotation further containing means for locking said means for containing into said operating location, hand-operated means, operable by a single hand of a user, for unlocking said means for containing to permit rotation thereof, means for permitting rotation of said means for containing using said single hand of said user that is used for unlocking, means for driving a staple from said selectable one, said means for driving including means for lowering a staple container a distance required to bring a bottom of said staple container into contact with a top surface of an object, and for thereafter driving said staple into said object, and means for indicating said distance, whereby a required staple length can be determined.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENTS

Figure 2:
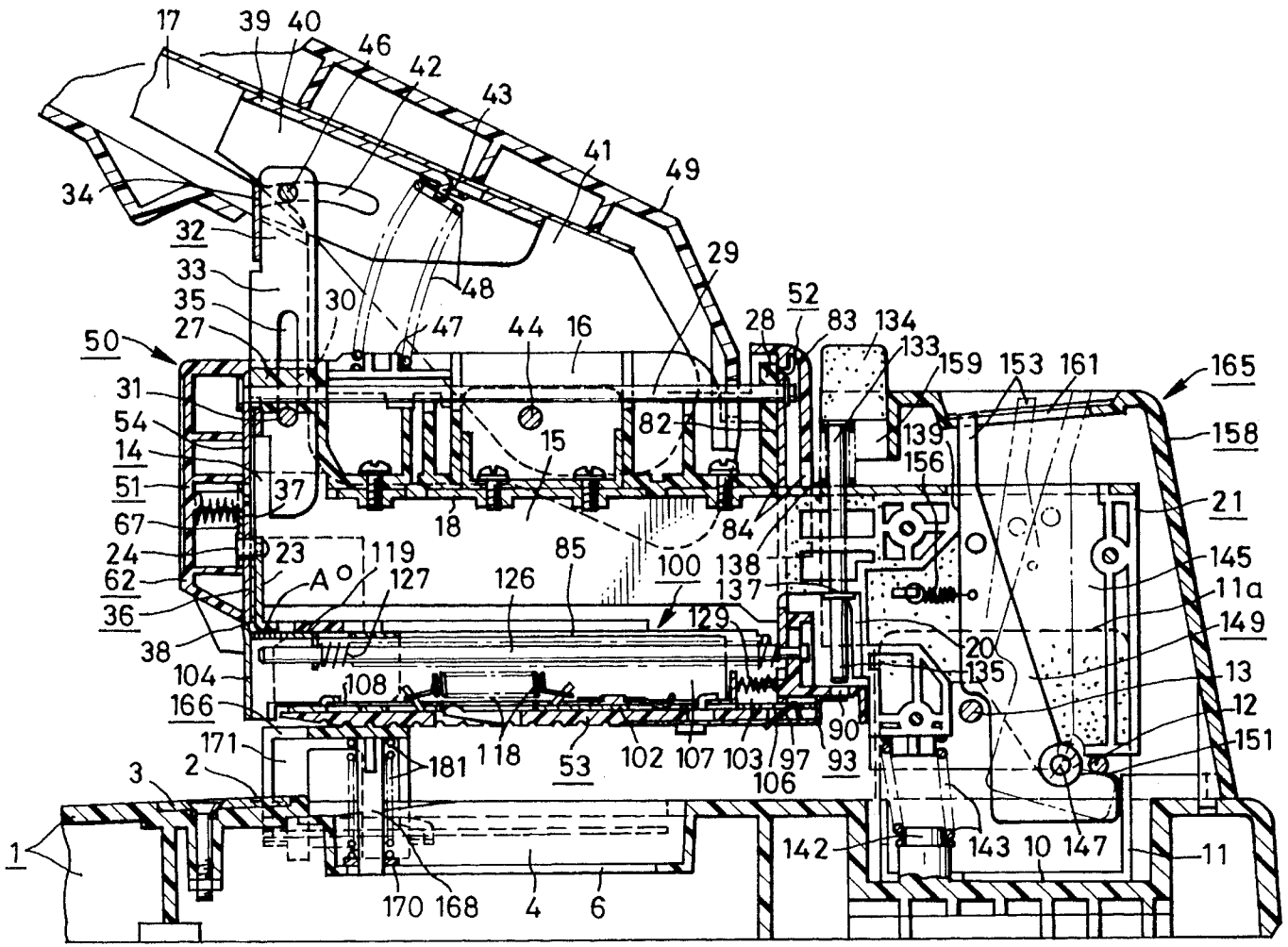
FIG. 2 is a cross-section of the stapler according to the present invention.
Figure 3:
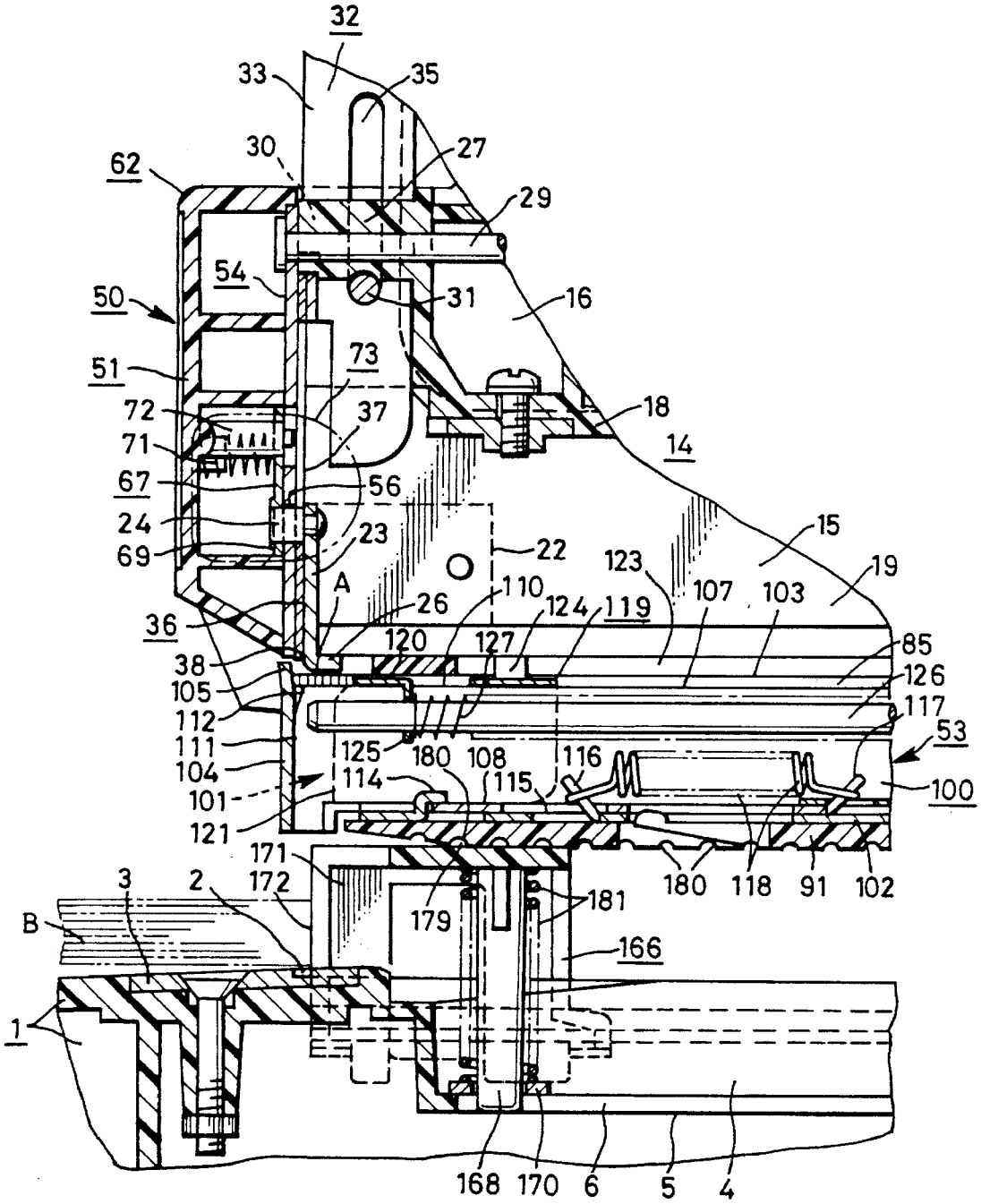
FIG. 3 is an enlarged cross-section of a front portion of the stapler of FIG. 2.

Referring to FIGS. 2 and 3, an upper surface of a body base 1 has a depression in which an anvil plate 3 is secured at a position slightly forward of its center. Anvil plate 3 has an anvil indentation 2. A top of anvil plate 3 is flush with the upper surface of body base 1. A center guide recess 4, located at about the widthwise center of body base 1, extends rearward from the vicinity of anvil plate 3 along the length of body base 1.

Figure 10:
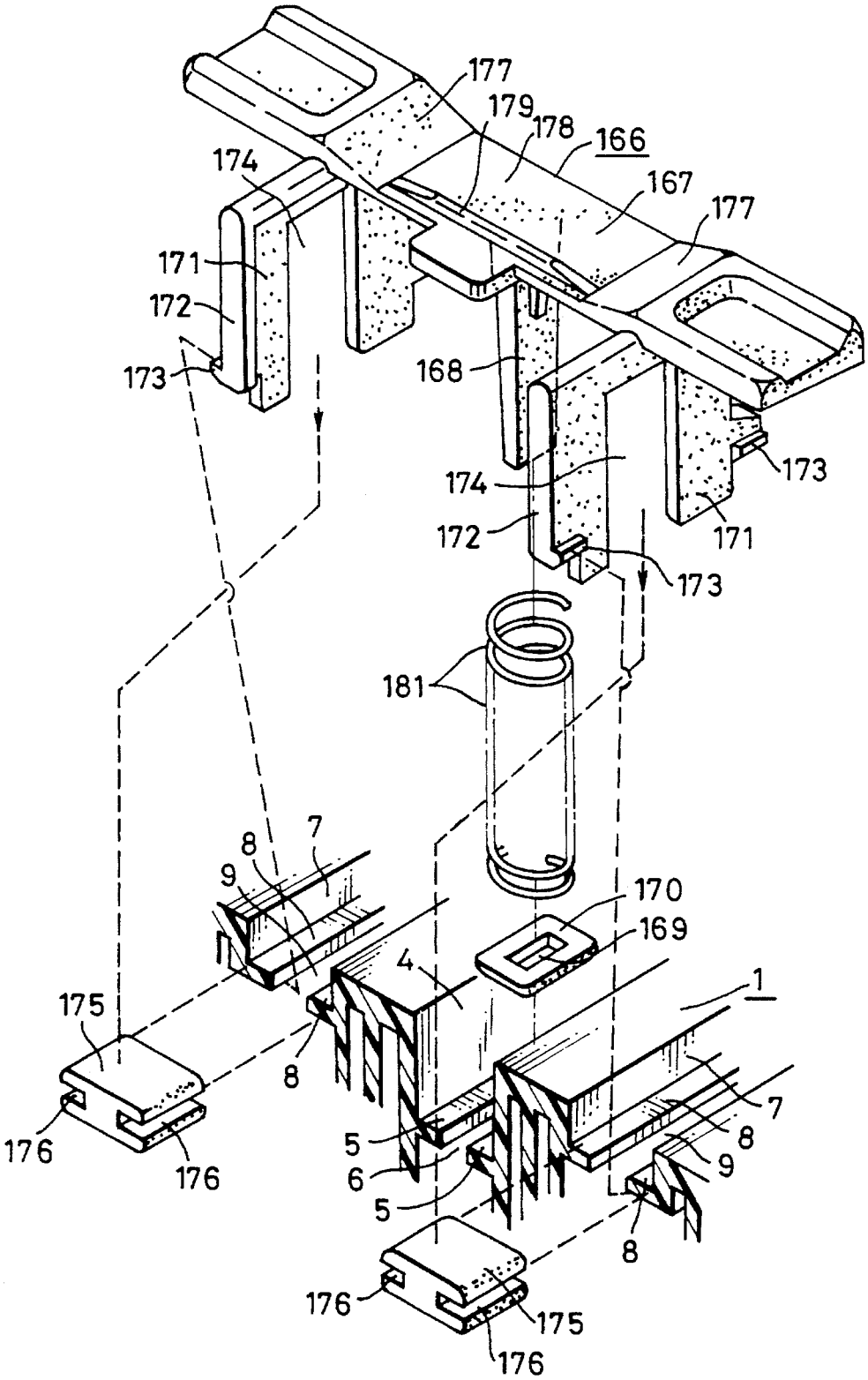
FIG. 10 is an exploded oblique view, partially in cross section, of a stopper assembly.

Referring also to FIG. 10, a parallel pair of guide plates 5 define a guide channel 6 therebetween, which extends along the bottom of guide recess 4. A pair of slide recesses 7 flank guide recess 4 and extend along body base 1 from the vicinity of anvil plate 3. A pair of parallel slide plates 8 define a slide channel 9 at the bottom of each slide recess 7.

Figure 4:
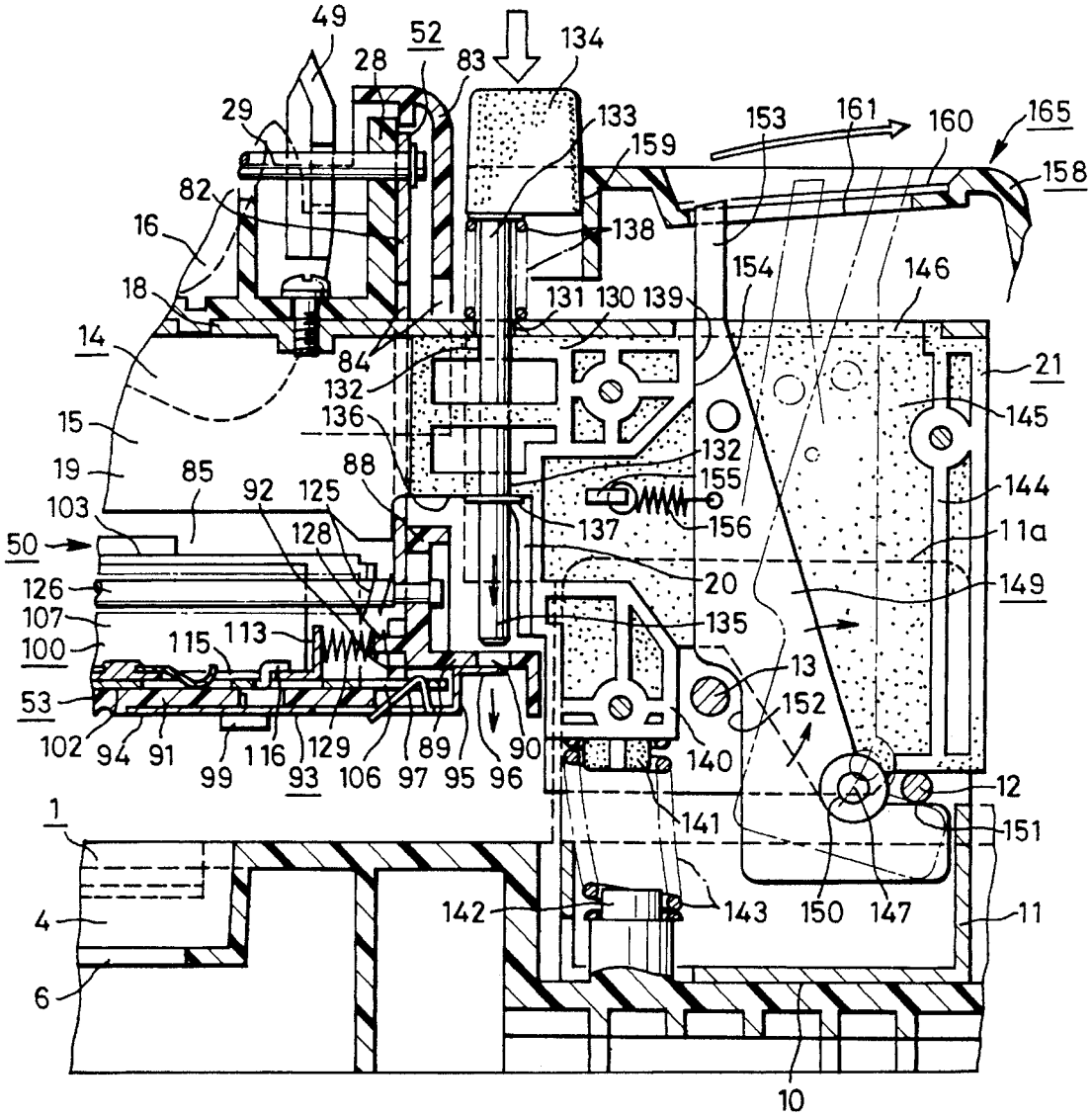
FIG. 4 is an enlarged cross-section of a rear portion of the stapler of FIG. 2.

Referring now to FIGS. 2–4, body base 1 has a mounting recess 10 for receiving a mounting bracket 11. Mounting bracket 11 includes a pair of parallel mounting plates 11*a*. A rod-shaped stopper 12 and a rotational shaft 13 are laterally positioned between mounting plates 11*a*. Rod-shaped stopper 12 and rotational shaft 13 secure mounting plates 11*a* at their lower rear and upper front portions, respectively.

An operating assembly 14 consists of an operating arm 15, a mounting frame 16, and an operating handle 17. Operating arm 15 is essentially an upside down U-shape, with a metal top plate 18 and a pair of metal side plates 19. Mounting frame 16 is secured to top plate 18 of operating arm 15. Mounting frame 16 can be made of any convenient material such as, for example, a synthetic resin. Operating handle 17 attaches to the upper portion of mounting frame 16.

Rectangular mounting bases 20 are integrally formed at a rear of each of side plates 19. Mounting bases 20 are connected to mounting plates 11*a* for rotation around rotational shaft 13. A molded synthetic resin block 21 is fixed between mounting bases 20.

A suspension rod 29 is connected between a supporting ridge 27 at a front of top plate 18 and a rear plate 28 at the rear of top plate 18. Vertical guide grooves 30 are formed at both sides of the front end of supporting ridge 27. A laterally extending guide rod 31 is fixed to the lower portion of supporting ridge 27.

Figure 1:
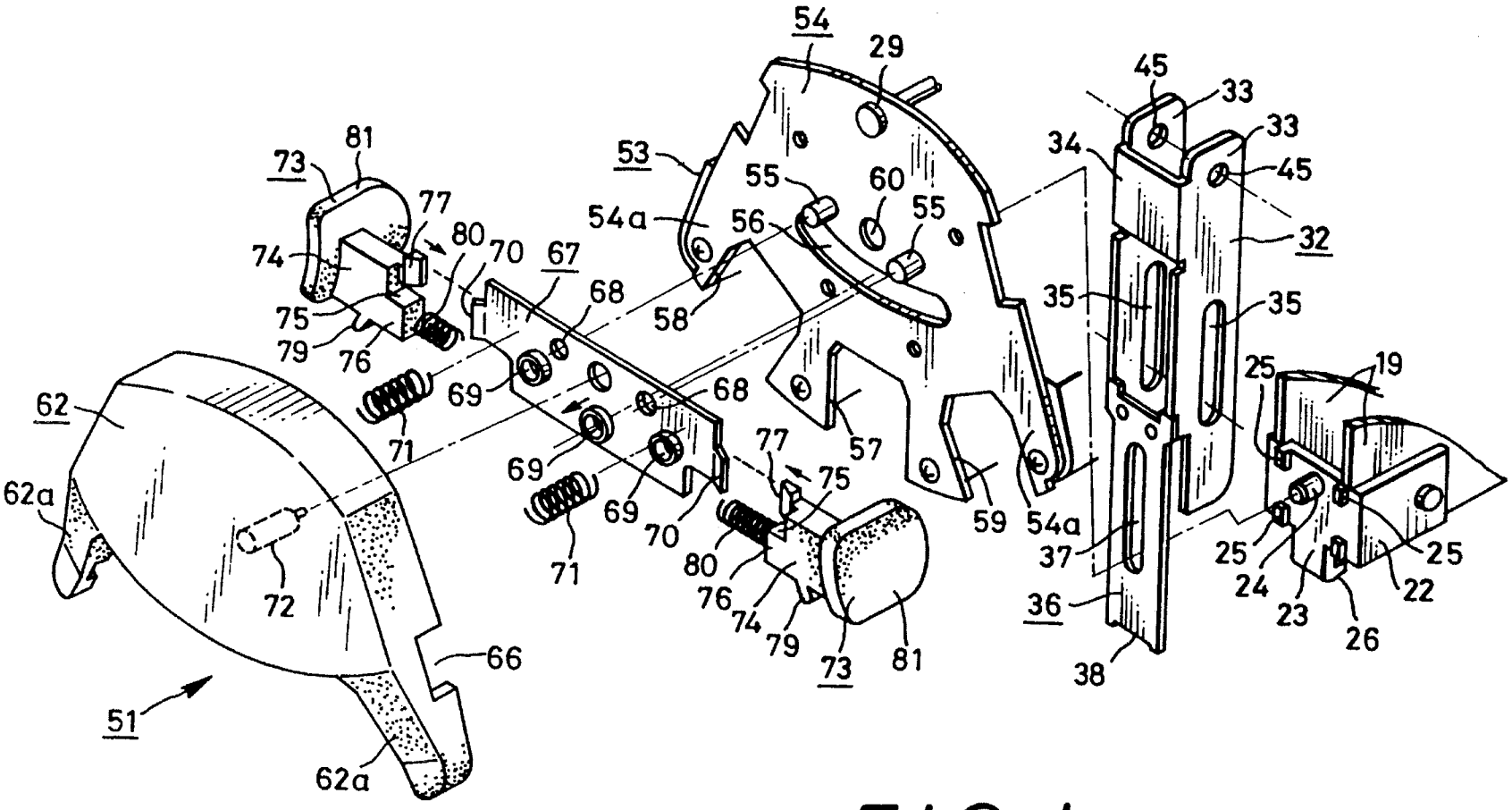
FIG. 1 is an exploded oblique view of the staple container locking portion of the preferred embodiment of the present invention.

Referring now to FIG. 1, a link 22 is secured between side plates 19. A lock pin 24 protrudes forward from a front face 23 of link 22. Front face 23 has four guides 25 projecting forward from its corners. A bottom of front face 23 is bent rearward below lock pin 24 to form a guide piece 26.

Referring now to FIGS. 1 and 2, an elevating frame 32 includes a supporting piece 34 which connects a pair of parallel vertical side plates 33. Side plates 33 engage vertical guide grooves 30, allowing vertical movement of elevating frame 32.

A pair of vertically elongated parallel guide grooves 35 in side plates 33 receive guide rod 31. A follow blade 36 is connected to the lower front ends of side plates 33 between guides 25 at the four corners of link 22.

Follow blade 36 has a follow portion 38 at its bottom and a vertically elongated guide groove 37 therethrough for the insertion of lock pin 24. Movement of frame 32 moves follow blade 36 up and down along lock pin 24 and between guides 25.

Operating handle 17 is a metal member extending along the length of body base 1. A metal reinforcing member 39 fits securely in the longitudinal middle portion of operating handle 17. Reinforcing member 39 is flanked by parallel side plates 40. Operating handle 17 is likewise flanked by parallel side plates 41. Crescent-shaped guide grooves 42 are formed in side plates 40 of reinforcing member 39, and in side plates 41 of operating handle 17. Side plates 41 are mounted on a shaft 44, which is positioned between side plates 19, thereby allowing operating handle 17 to rotate around shaft 44. A synthetic resin cover 49 envelops operating handle 17.

A sliding shaft 46 is inserted through insertion holes 45 at the upper end of each side plate 33. Sliding shaft 46 moves along crescent-shaped guide grooves 42 when operating handle 17 is actuated. The ends of a coil spring 48 engage, and receive support from, a stopper 43 and a stopping ridge 47.

Stopper 43 is formed by notching and bending downward the rear portion of reinforcing member 39. Coil spring 48 continuously biases operating handle 17 upward, with rotational shaft 44 acting as a fulcrum. Sliding shaft 46 engages crescent-shaped guide grooves 42 of operating handle 17, pulling elevating frame 32 upward such that the bottom of guide groove 35 engages guide rod 31. Guide rod 31 limits the upward mobility of elevating frame 32 and operating handle 17, and places follow blade 36 in a position for punching staples.

Figure 6:
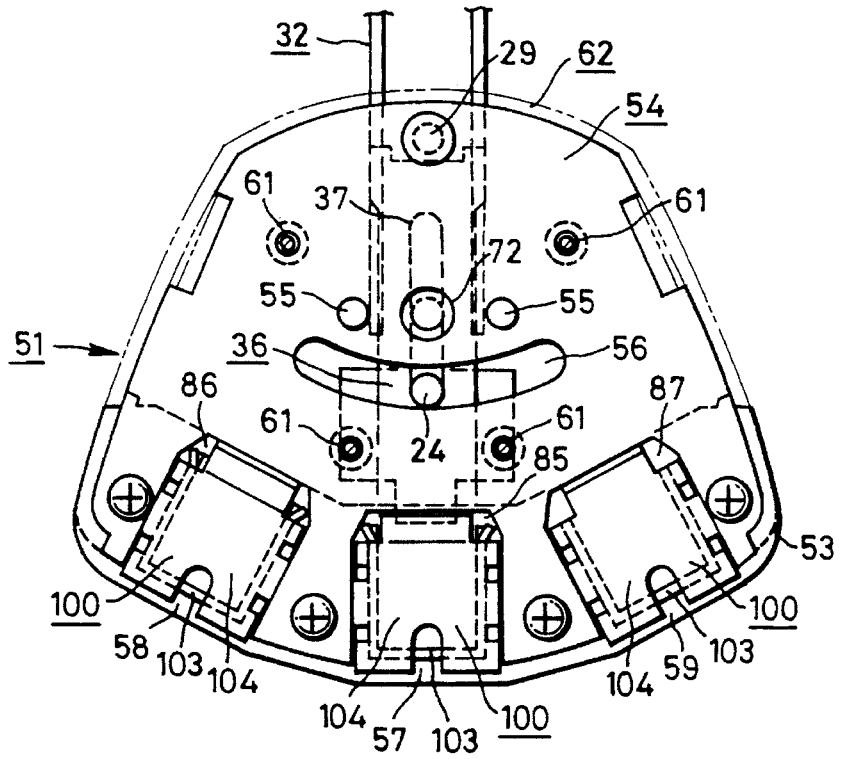
FIG. 6 is a front view of the staple container portion of the preferred embodiment of the invention.

Referring to FIGS. 2 and 6, a staple container 50 consists of a pair of parallel fan-shaped supporting members 51 and 52 at the front and rear ends of suspension rod 29, respectively, with a crescent-shaped magazine 53 made from a synthetic resin therebetween. Supporting members 51 and 52 and magazine 53 rotate laterally about suspension rod 29.

Referring to FIGS. 1 and 6, the front of suspension rod 29 supports the upper end of a guide plate 54. Guide plate 54 has an insertion hole 60 between a pair of guide pins 55. Guide pins 55 are spaced apart and project forward from guide plate 54. A crescent shaped guide groove 56 below guide pins 55 engages lock pin 24 of operating assembly 14. A middle guide recess 57, which is open at its bottom, is formed directly below guide groove 56. A pair of side guide recesses 58 and 59, which are also open at their bottoms, are formed at the bottom of guide plate 54 and flank middle guide recess 57.

Figure 5:
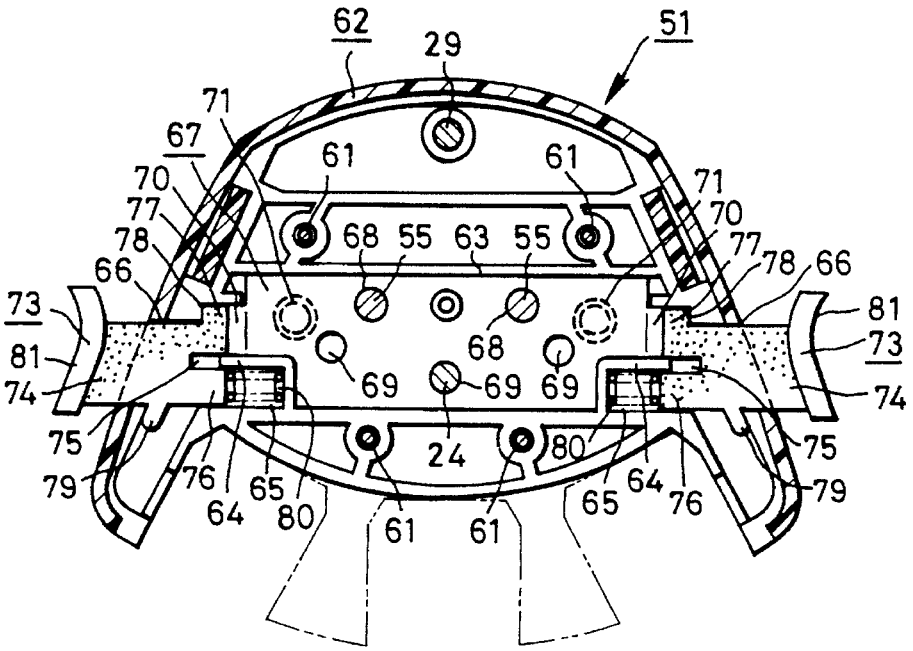
FIG. 5 is a cross-section of the staple container portion of the preferred embodiment of the present invention.

Referring to FIGS. 1 and 5, front supporting member 51 has a fan-shaped cover assembly 62 of synthetic resin fixed to guide plate 54 by four screws 61. Cover assembly 62 has a plate housing recess 63 which is open at its lateral ends. A pair of partition pieces 64 abut lower corners of plate housing recess 63, forming a pair of spring housing recesses 65. A pair of guide recesses 66 are located at the lateral sides of cover assembly 62.

A lock plate 67 fits snugly in plate housing recess 63 for constraint in lateral directions, but remains free to move in the fore and aft directions. A pair of covering members 62*a* project downward diagonally from the lower corners of cover assembly 62. Covering members 62*a* are integrally formed with cover assembly 62 to cover the front of projecting portions 54*a* on each side of guide plate 54.

Lock plate 67 has a pair of insertion holes 68 for engaging guide pins 55, and three laterally spaced lock holes 69 for selectively engaging lock pin 24. Lock holes 69 are overlapped by guide groove 56.

A pair of cam pieces 70 project diagonally forward at a prescribed angle from both lateral ends of lock plate 67. A pair of coil springs 71 disposed laterally inside plate housing recess 63 between center assembly 62 and lock plate 67, continuously bias lock plate 67 towards guide plate 54. Movement of lock plate 67 is limited by a guide pin 72 projecting rearward from cover assembly 62 through insertion hole 60 of guide plate 54.

A pair of operation buttons 73 engage guide recesses 66 at both sides of cover assembly 62. A rectangular sliding portion 74 of operation buttons 73 fits in guide recesses 66. A horizontally notched channel 75 between a top and bottom of an internal end of sliding portion 74 freely allows operating buttons to 73 to slide over partition piece 64 when pressed into guide recesses 66. A catching shoulder 76 under notched channel 75 faces an open end of spring housing recess 65. Pressure on curved operating members 81 moves operation buttons 73 laterally.

A cam 77 projects diagonally from above notched channel 75. An angle of cam 77 allows its upper end to catch a stepped portion 78 above guide recess 66. A protrusion 79 at a middle of a lower surface of sliding portion 74 catches a lower edge of guide recess 66. A pair of coil springs 80 are disposed in spring housing recesses 65 facing catching shoulders 76 of operation buttons 73, continuously biasing operation buttons 73 outward. Curved operating members 81 are integrally formed at an outer end of sliding portions 74.

Referring now to FIGS. 2 and 4, rear supporting member 52 has a hanging plate 82 which is supported at its upper end by suspension rod 29 and can rotate about suspension rod 29. A plastic cover 83 is fitted over a rear face of hanging plate 82. Guide holes 84 in hanging plate 82 and cover 83 allow insertion of operating arm 15 and lateral rotation of hanging plate 82.

Referring now to FIG. 6, magazine 53 contains three staple clip cases 85, 86, and 87 which extend along the length of body base 1 with their fronts open. Staple clip cases 85, 86 and 87 fit into middle guide recess 57 and side guide recesses 58 and 59, respectively.

Figure 8:
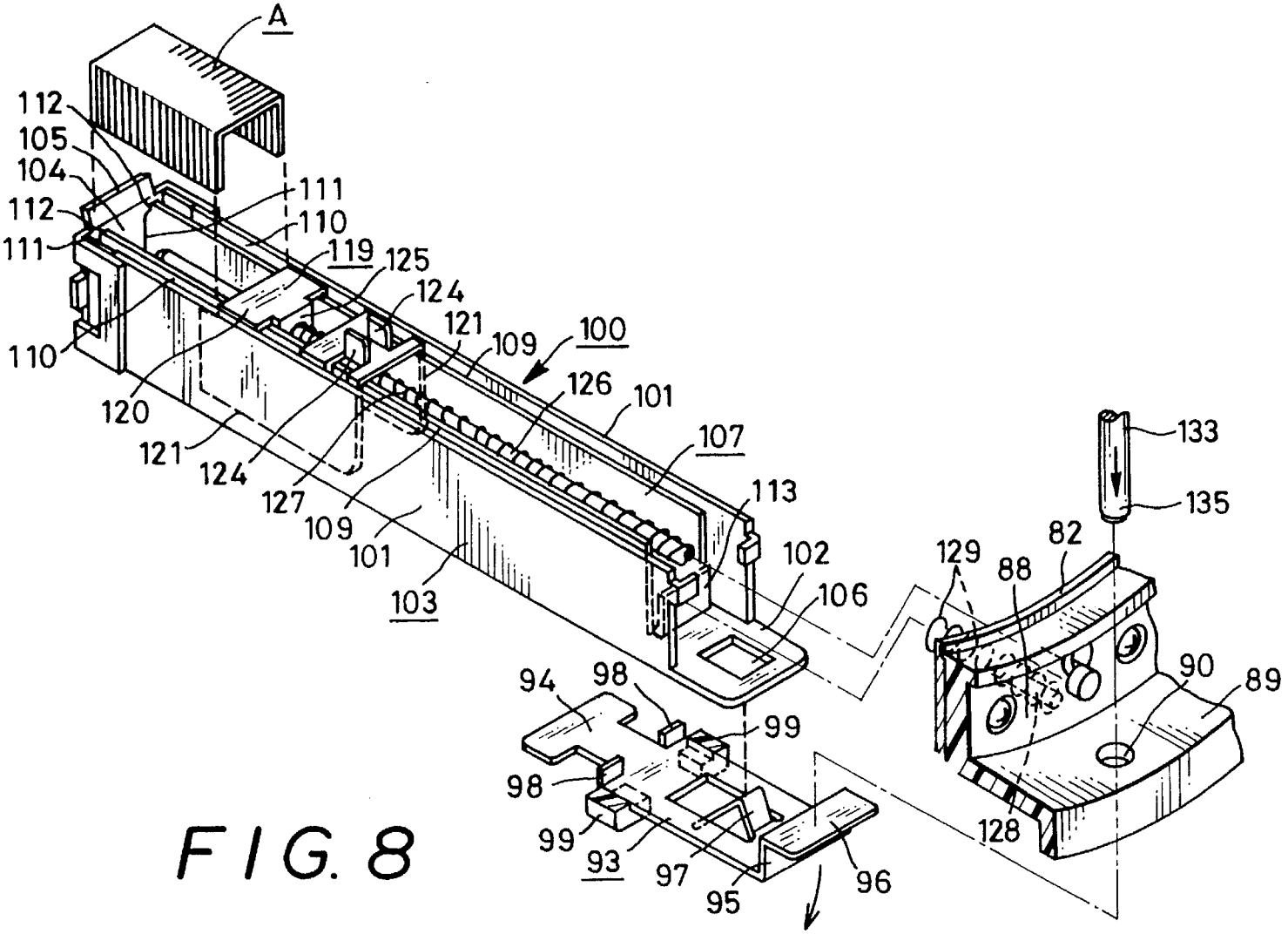
FIG. 8 is an exploded oblique view, partially in cross section, of the locking mechanism of a staple clip.

Referring now to FIGS. 4 and 8, a block plate 88 closes the collective rear of staple clip cases 85, 86, and 87. A catching ledge 89, formed integrally with block plate 88, projects rearward. Guide holes 90 in catching ledge 89 align with staple clip cases 85, 86, and 87 at their selected positions. A laterally elongated hole 92 is formed where each staple clip case 85, 86, and 87 connects to block plate 88.

Lock plates 93, each consisting of a plate spring, is fixed to a lower rear end of a base portion 91 of each staple clip case 85, 86 and 87. Each lock plate 93 has an approximately T-shaped fixed portion 94 extending from its front end which is fixed to the lower surface of corresponding base portion 91. The rear portion of lock plate 93 is formed into an upwardly extending vertical portion 95 and a movement receiving piece 96 which extends horizontally from vertical portion 95. When one of staple clip cases 85, 86 and 87 are at the selected position, movement receiving piece 96 is positioned below guide hole 90 to engage catching ledge 89.

A stopper 97, which is formed by cutting and pushing up a portion of lock plate 93, is disposed between movement receiving piece 96 and fixed portion 94. A pair of laterally aligned insertion pieces 98 engage the lower surface of base portion 91. A pair of protrusions 99, on the upper surface of base 91 adjacent to insertion pieces 98, sandwich and support lock plate 93.

Each of staple clip cases 85, 86, and 87 receives a staple clip 100 for containing a strip of staples A, wherein each of the three staple clips 100 is designed to hold a different size staple. Each staple clip 100 extends lengthwise along body base 1 and moves back and forth for insertion or removal from magazine 53. It is equally within the contemplation of the invention that two or more staple clip 100 may accommodate the same size staple, thereby extending the supply of staples available before requiring replenishment.

Staple clip 100 has a U-shaped clip body 103 consisting of a pair of parallel side plates 101 connected by a base plate 102. A guide plate 104 between the front ends of side plates 101 provides a path for guiding a punched staple downward. A guide piece 105 at the upper end of guide plate 104 inclines forward. A stopper hole 106, which stopper 97 of lock plate 93 engages, is located near the rear of base plate 102.

A rail 107 moves fore and aft within clip body 103. Rail 107 consists of a pair of upward-facing parallel guide rails 109 connected by a movable base plate 108 on base plate 102. A staple containing section 110, which supports the tines of staples A, is defined by spaces between guide rails 109 and side plates 101 of clip body 103. The upper front end of each guide rail 109 is chamfered to form a guide 112. The remainder of the front end of each guide rail 109 forms an abutting surface 111 for guide plate 104. An abutting projection 113 at the rear end of movable base plate 108 projects vertically upward to close a lower portion of the U shape of rail 107, and to make the structure more rigid.

Referring now to FIGS. 2, 3 and 8, a stopper protrusion 114 extends upward from base plate 102 to limit forward movement of the front end of movable base plate 108. A rear mounting piece 117 projects upward from movable base plate 108 through guide hole 115. A front mounting piece 116 is formed by cutting and bending upward a portion of base plate 102. A coil spring 118 stretches between mounting pieces 116 and 117 to bias rail 107 toward stopper protrusion 114 of base plate 102. The front end of guide rails 109 and the rear edge of guide holes 115 abut guide plate 104 and rear mounting piece 116.

A slider 119 is resiliently urged forward by a coil spring to bias a strip of staples A forward along guide rails 109. Slider 119 is an inverted U-shape, consisting of a horizontal portion 120 and a pair of vertical portions 121, which apply pressure to the top and tines of strip of staples A, respectively.

Figure 7:
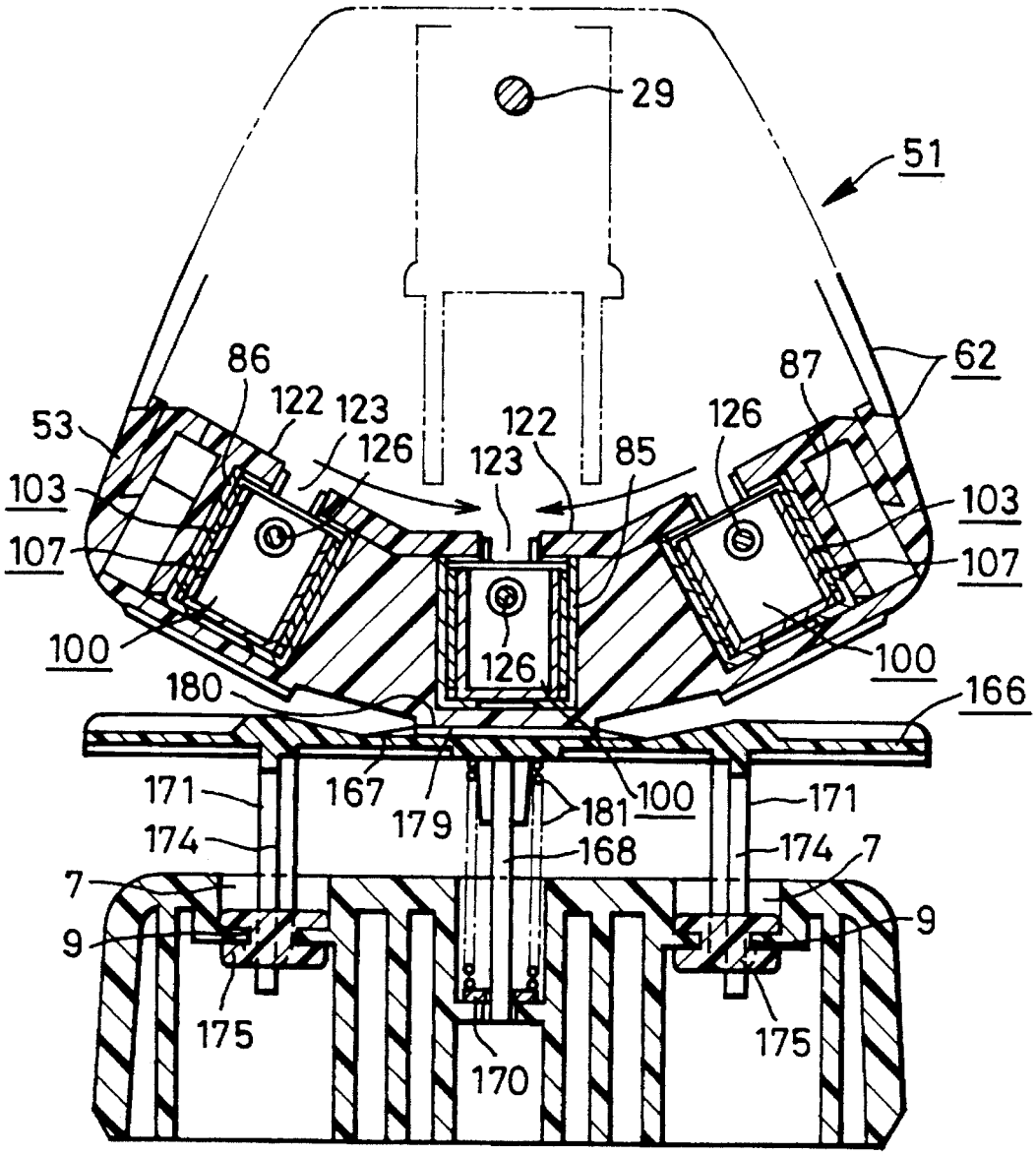
FIG. 7 is a cross-section of the staple container and a stopper assembly.

Referring now to FIGS. 7 and 8, a pair of sliding pieces 124 project upward from the rear of the top of horizontal portion 120. Sliding pieces 124 slide along a pair of guide channels 123 in a top portion 122 of each staple clip case 85, 86, and 87. A supporting piece 125 projects downward from the middle of horizontal portion 120 to abut a forward end of coil spring 127.

Supporting piece 125 slides over a guide rod 126. The rear of guide rod 126 is attached to block plate 88. Coil spring 127, threaded on guide rod 126 between supporting piece 125 and block plate 88, biases slider 119 forward along guide rails 109.

Connector protrusions 128 protrude forward from block plate 88 at locations corresponding to the selected positions of staple case 85, 86, and 87. Coil springs 129, wound on connector protrusions 128, bias abutting projection 113 to urge its corresponding staple clip 100 in the forward direction.

To install staple clip 100, staple clip 100 is pushed backward against coil spring 129 until stopper 97 is first depressed, and then pops into stopper hole 106. Engagement of stopper 97 in stopper hole 106 locks staple clip 100 in position until it is released, as will be explained.

Referring now to FIGS. 2–4, a portion of staple clip 100 between guide piece 105 and guide 112 is aligned below follow portion 38. Coil spring 128 pushes staples A via slider 119 such that the first staple abuts guide plate 104 directly below follow portion 38.

Block 21 is sandwiched between mounting bases 20. A supporting member 130 protrudes outward integrally from the upper front end of block 21. A vertical through hole 132 through block 21 is aligned with a guide hole 131 and guide hole 90 forward of supporting member 130.

A vertically movable operating rod 133 passes through guide hole 131 and through hole 132. Operating rod 133 has a push button 134 fixed to its upper end and, a stopper 137 fixed to its middle. A coil spring 138 around operating rod 133 biases operating rod 133 in the upward direction. Upward movement of operating rod 133 is arrested by stopper 137, which engages a lower surface 136.

A mounting member 140 projects outward from the front bottom of block 21, with its projecting side aligned with that of supporting member 130. A coil spring 143 is disposed between a base 141 at the bottom of mounting member 140 and a base 142 at the upper rear of body base 1. Coil spring 143 biases magazine 53, which is rotatably supported by operating assembly 14 around rotational shaft 13. Magazine 53 is thus supported at a position above anvil indentation 2.

Figure 9:
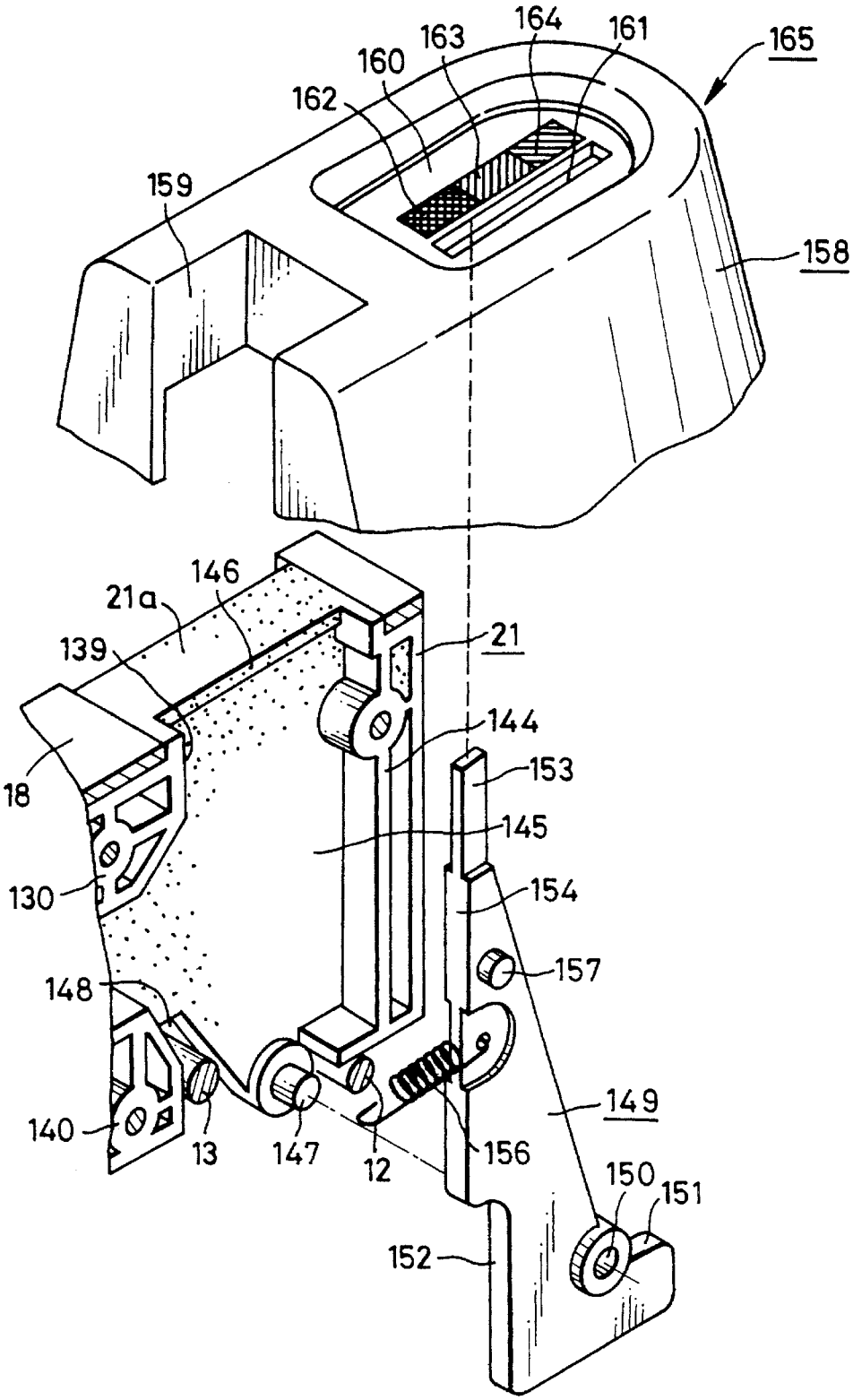
FIG. 9 is an exploded oblique view of an indicator assembly.

Referring now also to FIG. 9, a vertically elongated partition 144 projects outward flush with supporting member 130 and mounting member 140. A top plate 21*a* connects supporting member 130 and partition 144. Partition 144, supporting member 130 and mounting member 140 define a housing recess 145. A guide groove 146 is created above housing recess 145 by supporting member 130, partition 144, and top plate 21*a*.

A shaft 147 projects laterally from the bottom of housing recess 145. A clearance recess 148 between shaft 147 and mounting member 140 prevents rotational shaft 13 from abutting block 21. Mounting bases 20 abut supporting member 130, mounting member 140 and partition 144, thereby closing housing recess 145.

A vertically extending indicator plate 149 is made of synthetic resin. An insertion hole 150 near the rear of indicator plate 149 engages shaft 147, allowing indicator plate 149 to rotate. A vertical pointer 153 at the top of indicator plate 149 projects upward through guide groove 146. A cut-out recess 152 prevents rotational shaft 13 from coming into contact with indicator plate 149.

A catching ridge 151 projects horizontally rearward behind insertion hole 150 to abut stopper 12. A vertical abutting surface 154 at the upper front end of indicator plate 149 abuts a stopping portion 139 of supporting member 130, thereby limiting counter-clockwise rotation of indicator plate 149.

Referring now to FIGS. 2, 4 and 9, a coil spring 156 is disposed between the portion of indicator plate 149 under abutting surface 154 and a protrusion 155. Coil spring 156 continuously biases indicator plate 149 counterclockwise about shaft 147. This rotation stops when abutting surface 154 contacts stopping portion 139.

Lateral guidance of indicator plate 149 is provided by a pair of guides 157. Guides 157 project laterally from both sides of the upper portion of indicator plate 149 and slide along housing recess 145 and mounting bases 20.

A cover assembly 158 attaches to the upper rear of body base 1 to cover mounting bases 20 and block 21. Cover assembly 158 is made of synthetic resin. Cover assembly 158 has a housing recess 159 for accommodating push button 134. A recess 160 contains a guide groove 161 for receiving pointer 153. Three display panels 162, 163, and 164 of an indicator assembly 165 are disposed alongside guide groove 161. The position of pointer 153, relative to display panels 162, 163 and 164, indicates the length of staple required to accommodate a particular stack of paper.

For example, if the staple strips contained in staple clip cases are, 15 mm, 10 mm, and 6 mm, respectively, then these staple sizes are represented by display panels 162–164. Thus, indicator assembly 165 selectively indicates which strips of staples A should be selected for a particular stack of paper.

Referring now to FIG. 10, a stopper assembly 166 is used for limiting insertion of a stack of paper into body base 1 to a position appropriate for stapling. An abutting plate 167 extends laterally below the lower surface of magazine 53. A supporting plate 168 projects vertically downward into guide channel 6 of body base 1 to permit up and down motion of supporting plate 168 as well as back and forth motion. A sliding piece 170 between supporting plate 168 and guide channel 6 has an elongated guide hole 169, which accepts supporting plate 168. Sliding piece 170 slides along the upper surface of guide plates 5.

A pair of sliding plates 171 project vertically downward to engage slide channels 9 at both sides of body base 1 so that sliding plates 171 move up and down as well as slide back and forth. A stopper 172 extends horizontally from the front of each sliding plate 171. A ridge 173, which acts as a stopper, abuts the lower surface of corresponding slide plate 8.

A pair of guide recesses 174 have a pair of vertically movable braking members 175 inserted therein to prevent stopper assembly 166 from toppling forward or backward. Braking members 175 are I shaped, with a catching groove 176 at each side to engage slide plates 8. A nearly horizontal abutting portion 178 and a pair of guide slopes 177 guide the lateral movement of magazine 53 as magazine 53 rotates around suspension rod 29.

Referring now also to FIG. 3, a catching ridge 179 projects upward from the top of abutting portion 178 to engage a selected one of catching grooves 180 in the lower surface of magazine 53. A coil spring 181 around supporting plate 168 between the lower surface of abutting plate 167 and sliding piece 170 biases stopper assembly 166 upward so that ridges 173 engage slide plates 8, thereby fixing stopper assembly 166 in the selected position. Stopper assembly 166 can be repositioned by forcibly urging stopper assembly forward or backward, optionally while pressing stopper assembly 166 downward against the force of coil spring 181. Sliding piece 170 slides with supporting plate 168 along guide plates 5, while braking members 175 in guide recesses 174 slide along both pairs of slide plates 8. Thus, stopper assembly 166 is adjustable smoothly to a desired stapling position for stack of paper B.

Figure 11:
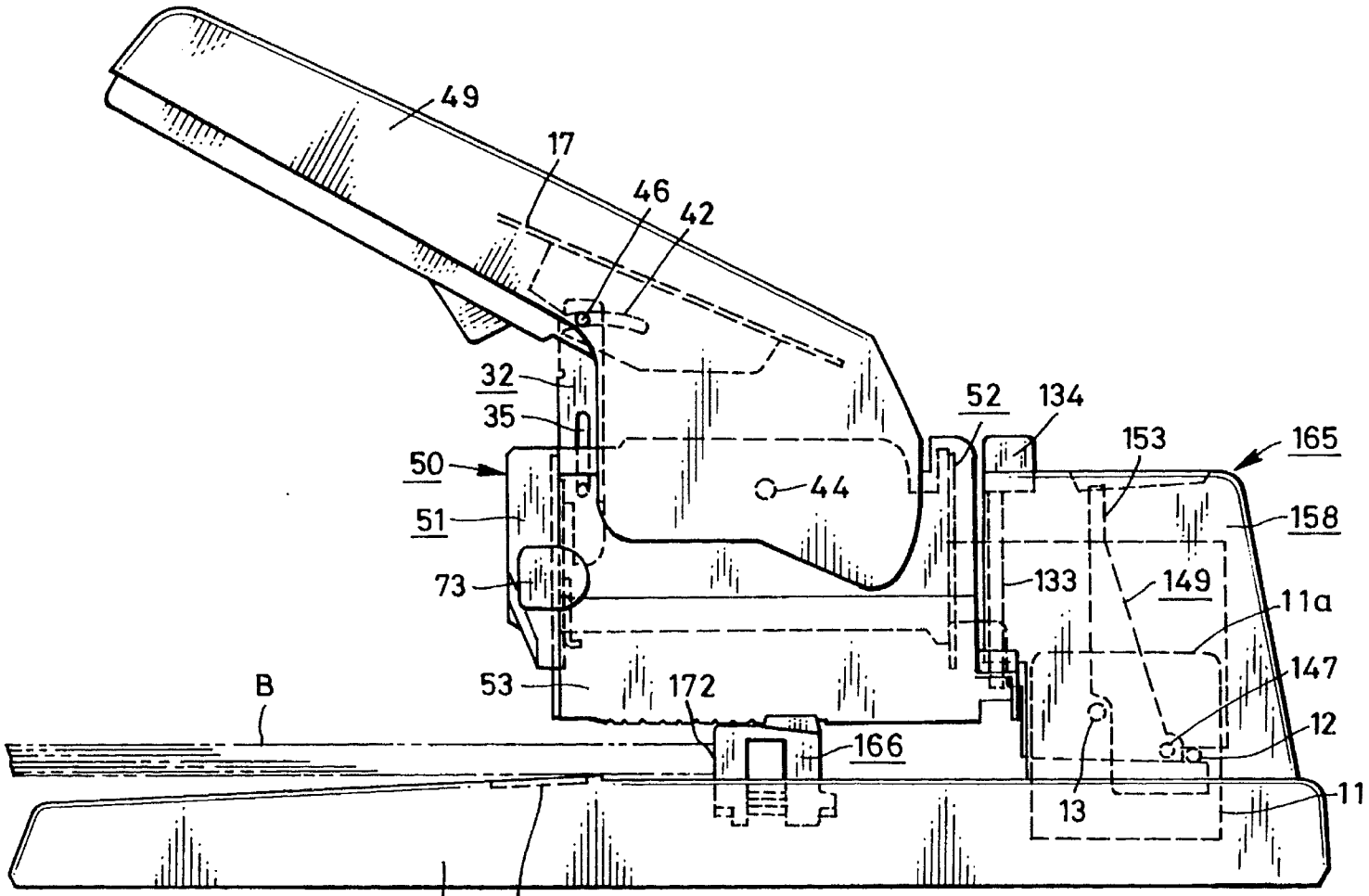
FIG. 11 is a side view of a stapler according to a preferred embodiment of the invention.
Figure 12:
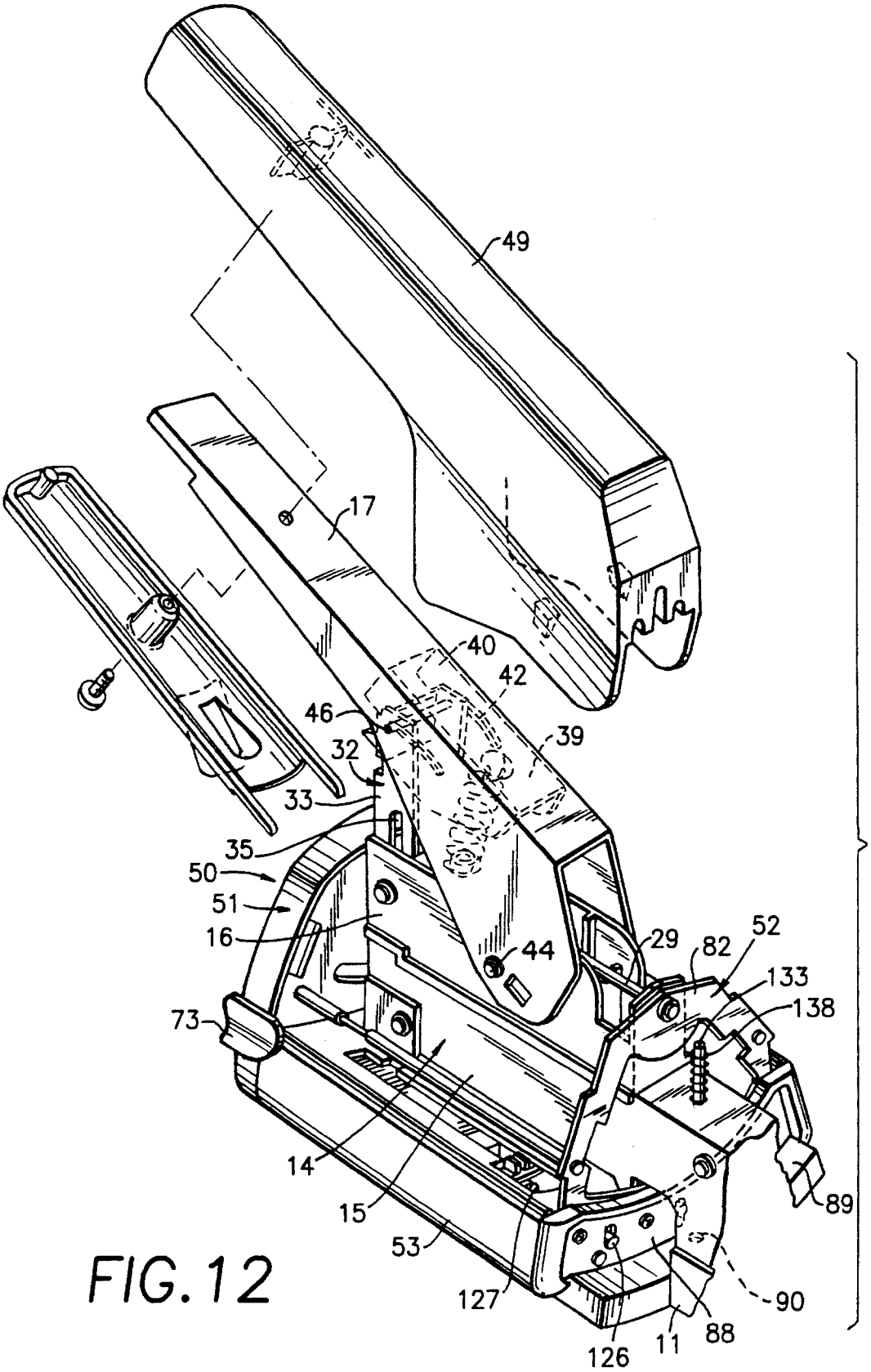
FIG. 12 is an exploded perspective view of the staple container and an operating assembly according to the present invention.
Figure 13:
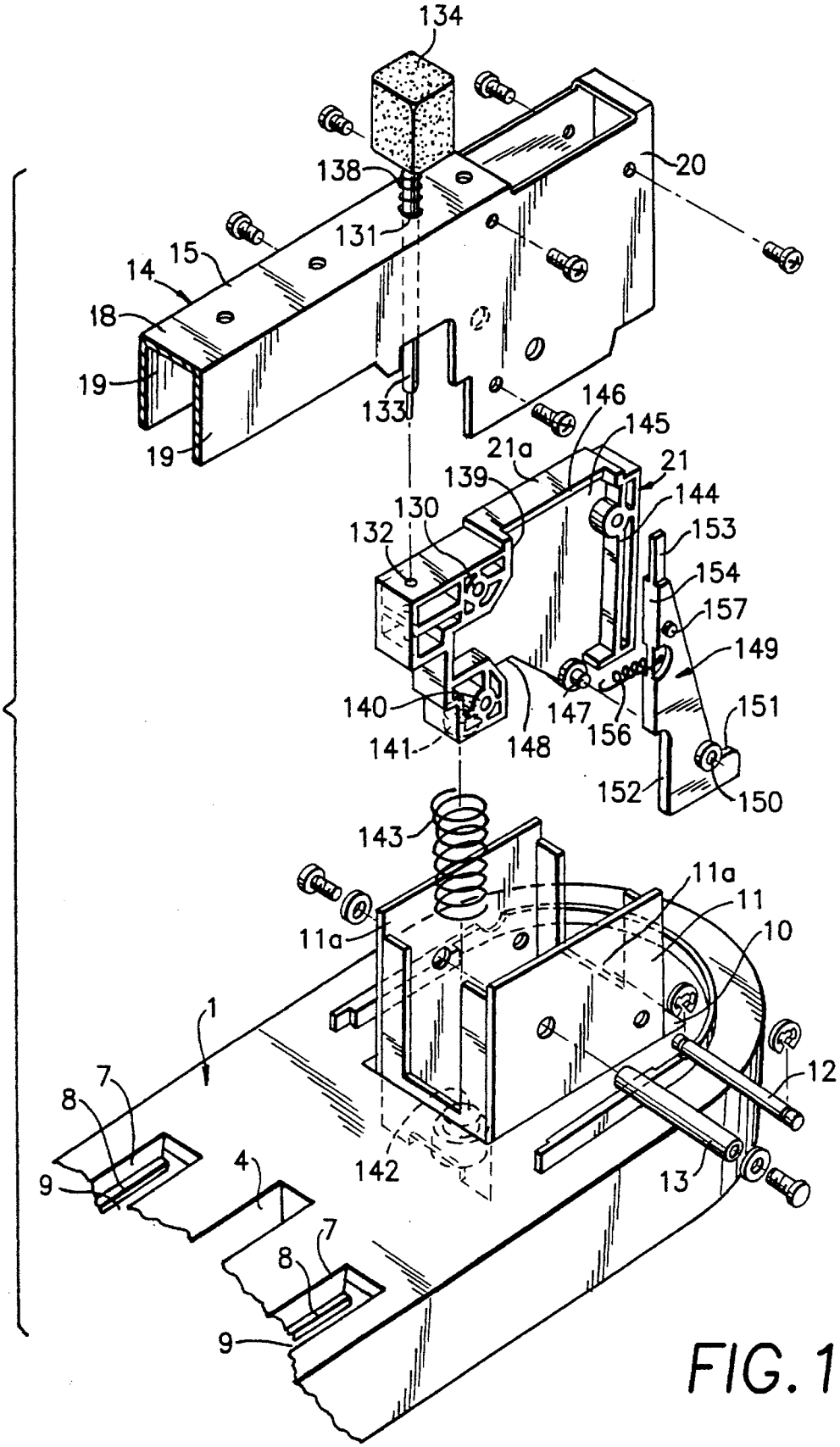
FIG. 13 is a fragmentary exploded perspective view of a base and mounting base according to the present invention.

Referring now to FIGS. 2 and 11, in use, stack of paper B is inserted over anvil indentation 2 to abut stoppers 172 of stopper assembly 166. Depressing operating handle 17 rotates operating arm 15 counter-clockwise around rotational shaft 13 against the bias of coil spring 143 to press stopper assembly 166 downward against the force of coil spring 181 until the bottom of staple container 50 contacts the top of the stack of paper B. At this time, it may be desired to note the position of pointer 153 to determine whether the aligned staple clip case 85, 86 or 87 contains staples of the correct length for the thickness of the stack of paper B.

Referring now to FIG. 4, as operating arm 15 rotates around rotational shaft 13, catching ridge 151 of indicator plate 149 contacts stopper 12 from below, thereby rotating indicator plate 149 with respect to block 21. When operating arm 15 rotates further counterclockwise, block 21 rotates out of contact with abutting surface 154 about rotational shaft 13. Stopper 12 remains stationary, in turn forcing indicator plate 149 to rotate clockwise around shaft 147, with respect to block 21, due to the engagement between stopper 12 and catching ridge 151. When the bottom of staple container 50 contacts the top of stack of paper B, pointer 153 comes to rest at a position in guide groove 161 that is proportional to the thickness of stack of paper B. The operator is then able to note the one of display panels 162, 163 and 164 along which pointer 153 comes to rest to determine whether the correct one of staple clip cases 85, 86 or 87 is in use.

In the preferred embodiment, the above selection is made from among 6 mm, 10 mm or 15 mm staples. Depending on the thickness of stack of paper B, pointer 153 may not move from its initial position at display panel 162, which is the frontmost of the three display panels 162, 163, and 164 marked on cover assembly 158.

When operating handle 17 is released, operating arm 15 rotates clockwise to its original position around rotational shaft 13 under the force of coil spring 143. As a result, magazine 53 of staple container 50 lifts off of stack of paper B. Meanwhile, indicator plate 149 returns to its initial position under the force of coil spring 156. Abutting surface 154 rests against stopping portion 139.

Referring now to FIGS. 1 and 5, staples A, appropriate for the measured thickness of stack of paper B, are aligned above anvil indentation 2 by depressing operating members 81 of operation buttons 73 with the thumb and finger of one hand. When operation buttons 73 are depressed against coil springs 80, cams 77 push cam pieces 70 forward.

Referring now also to FIG. 3, cam pieces 70 move lock plate 67 away from guide plate 54 on guide pins 55 against the force of coil springs 71 until lock hole 69 at the selected position of lock plate 67 is moved out of engagement with lock pin 24, thereby releasing front supporting member 51 from lock pin 24. Still holding operation buttons 73 depressed with thumb and finger, staple container 50 is rotated around suspension rod 29 until the appropriate staple clip 100 is selected. Any staple containing section 110, containing staples A of a desired size, can be selectively positioned above anvil indentation 2. Meanwhile, the foremost of staples A in staple clip 100 is positioned directly below follow portion 38.

Once in position, operation buttons 73 are released. Operation buttons 73 are urged outward under the force of coil springs 80. Cams 77 disengage from cam pieces 70, thereby permitting coil springs 71 to move lock plate 67 on guide pins 55 toward guide plate 54. Lock pin 24 automatically fits into the selected position of lock hole 69 corresponding to the selected staple clip 100. Lock pin 24 thereby locks staple container 50 in the prescribed position.

As described above, when selecting a staple size to correspond to the thickness of stack of paper B, unlocking, adjusting, and locking staple container 50 is easily accomplished with one hand.

Referring now to FIGS. 2 and 3, depressing operating handle 17 lowers magazine 53 while operating assembly 14 rotates counter-clockwise around rotational shaft 13. The front end of clip body 103 contacts the upper surface of stack of paper B. As operating assembly 14 rotates further, sliding shaft 46 lowers elevating frame 32 vertically. Guide rod 31 guides the downward movement of elevating frame 32 via guide grooves 35. At the same time, follow blade 36 moves downward to bring the lower end of follow portion 38 into contact with the top of the foremost staple of strip of staples A between guide piece 105 and guide 112.

Further rotation of operating assembly 14 with operating handle 17 causes follow portion 38 to separate the foremost staple of strip of staples A and to force it downward. Referring to FIG. 8, when the horizontal portion of the foremost staple of strip of staples A comes between guide plate 104 and the front ends of guide rails 109, the horizontal portion of the staple moves rail 107 rearward against coil spring 118. As a result, guide piece 104 separates from abutting surfaces 111, but remains in close contact with the edge of the staple. This permits follow portion 38 to punch out the staple and fold the tines inward on anvil indentation 2. At that time, the abutting plane between guide piece 104 and abutting surfaces 111 of guide rails 109 are pushed apart, and the staple exits without lateral movement.

Referring now to FIG. 7, when abutting plate 167 moves downward, stopper assembly 166 is moved downward with catching ridge 179 of abutting plate 167 engaged in catching groove 180 of magazine 53. With certain thicknesses of paper stacks, magazine 53 does not move straight downward, but instead, in rotating about rotational shaft 13, the lower surface of magazine 53 may attempt to move abutting plate 167 in the backward or forward direction. This could cause stopper assembly 166 to topple. Laterally arranged braking members 175 prevent stopper assembly 166 from toppling. In the presence of lateral force on abutting plate 167, sliding plates 171 move horizontally on braking pieces 175. Therefore, stopper assembly 166 always moves vertically, regardless of where it is set in the longitudinal direction of the stapler.

Referring to FIGS. 6 and 8, staple clip 100 is fittable into a corresponding staple clip case 85, 86, and 87 from its corresponding guide recess 57, 58, and 59, respectively. When staple clip 100 is inserted, abutting projection 113 contacts the front of its corresponding coil spring 129. When staple clip 100 moves further inward, abutting projection 113 contracts coil spring 129, and the rear of base plate 102 contacts stopper 97.

If staple clip 100 is pushed further inward, lock plate 93 of stopper 97 bends downward, permitting the rear of base plate 102 to move past triangular stopper 97. Once staple clip 100 moves stopper hole 106 over the now depressed stopper 97, it returns to its original position and slips into stopper hole 106, locking staple clip 100 in position and the foremost of staples A in staple containing section 110 directly below follow portion 38.

When follow portion 38 punches out the foremost of staples A and returns to its rest position, slider 119 pushes staples A towards guide plate 104 under the force of coil spring 127, such that guide plate 104 positions the second (now foremost) staple directly below follow portion 38. Thus, each time stack of paper B is stapled, the remaining staples are pushed towards guide plate 104 to position the foremost one to be punched by follow portion 38.

Referring now to FIGS. 4 and 8, staple clip 100 is removed to load new staples A by depressing push button 134. This moves operating rod 133 of push button 134 through hole 132 against the force of coil spring 138. Pushing portion 135 applies pressure to movement receiving piece 96 through guide hole 90. As pushing portion 135 applies pressure to receiving piece 96, lock plate 93 bends elastically downward, displacing stopper 97 from stopper hole 106, and thereby unlocking clip body 103.

When staple clip 100 has been unlocked, the restoration force of coil spring 129 pushes abutting projection 113 forward. The front of staple clip 100 is moved outward with its front end protruding from front supporting member 51. Staple clip 100 is then manually pulled outward, and slider 119 moved toward the rear of the case to make room for staples A in staple containing section 110. Once filled, staple clip 100 is pushed back into staple clip case 85 as described above where it is locked with lock plate 93 to ready the staples for punching.

If a user wants to insert staples in another staple clip 100, the user moves that clip into the selected position in the same manner as when selecting that staple size. He then repeats the staple clip 100 removal procedure by depressing push button 134.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined the appended claims.

What is claimed is:

1. A stapler comprising:

means for containing at least first and second staple strips;

means, operable by a single hand of a user, for permitting rotation of said means for containing to bring a selectable one of said first and second staple strips into an operating location;

means, operable by said single hand, for locking said means for containing into said operating location;

means, operable by said single hand, for unlocking said means for containing to permit rotation thereof; and said means for permitting rotation, said means for locking, and said means for unlocking all being arranged to permit operation in a single sequence by said single hand of said user.

2. A stapler, comprising:

means for containing at least first and second staple strips;

means for permitting rotation of said means for containing to bring a selectable one of said first and second staple strips into an operating location;

means for locking said means for containing into said operating location;

means, operable by a single hand of a user, for unlocking said means for containing to permit rotation thereof;

means for permitting rotation of said means for containing using said single hand of said user that is used for unlocking;

said means for locking includes a lock plate;

means for restraining said lock plate against lateral motion, and for permitting motion perpendicular to a face of said lock plate;

at least first and second lock holes in said lock plate;

a stationary lock pin;

said means for locking includes resilient means for biasing said lock plate into a locking position wherein said lock pin enters a selected one of said at least first and second lock holes; and said means for unlocking includes operable means, operable from a front of said stapler, for moving said lock plate against said resilient means to disengage said lock pin from said selected one of said at least first and second lock holes.

3. Apparatus according to claim 2, wherein:

said means for unlocking includes at least one operation button accessible for actuation by said single hand;

said operable means including a cam portion on at least one of said lock plate and said operation button; and said cam portion being operative to move said lock plate.

4. A stapler comprising:

means for driving a staple;

said means for driving including means for lowering a staple container a distance required to bring a bottom of said staple container into contact with a top surface of an object, and for thereafter driving a staple into said object;

means for indicating a required staple length needed to penetrate said object;

said means for lowering including means for rotating said staple container about a first rotational center;

said means for indicating including an indicator plate;

means for permitting rotation of said indicator plate about a second rotational center;

said second rotational center being movable with said staple container;

a fixed stopper contacting said indicator plate, thereby producing relative rotation of said indicator plate with respect to said staple container;

a pointer on said indicator plate; and a display associated with said pointer from which a user can determine a thickness of said object.

5. A stapler comprising:

means for containing at least first and second staple strips;

means, operable by a single hand of a user, for permitting rotation of said means for containing to bring a selectable one of said first and second staple strips into an operating location;

means, operable by said single hand, for locking said means for containing into said operating location;

means, operable by said single hand, for unlocking said means for containing to permit rotation thereof;

said means for permitting rotation, said means for locking, and said means for unlocking all being arranged to permit operation in a single sequence by said single hand of said user;

means for driving a staple from said selectable one;

said means for driving including means for lowering a staple container a distance required to bring a bottom of said staple container into contact with a top surface of an object, and for thereafter driving said staple into said object; and means for indicating a required staple length needed to penetrate said object.

6. Apparatus according to claim 5 wherein:

said at least first and second staple strips contain staples of first and second different lengths; and said means for indicating includes means for indicating which of said first and second lengths is appropriate for said object.

* * * * *